US006213689B1

(12) United States Patent
Hirai

(10) Patent No.: US 6,213,689 B1
(45) Date of Patent: Apr. 10, 2001

(54) CONSTRUCTION UNIT FOR A RETAINING WALL AND A METHOD FOR CONSTRUCTING THE RETAINING WALL

(75) Inventor: Masatoshi Hirai, Tokyo (JP)

(73) Assignee: Tokusuke Co., Ltd., Tokyo (JP)

( * ) Notice: Subject to any disclaimer, the term of this patent is extended or adjusted under 35 U.S.C. 154(b) by 0 days.

(21) Appl. No.: 09/548,298

(22) Filed: Apr. 12, 2000

(51) Int. Cl.[7] ..... E02D 17/20; E02D 29/02

(52) U.S. Cl. ..... 405/284; 405/286; 52/583.1; 52/604

(58) Field of Search ..... 405/294, 286, 405/262; 52/604, 608, 609, 583.1

(56) References Cited

U.S. PATENT DOCUMENTS

| | | | | |
|---|---|---|---|---|
| 837,962 | * | 12/1906 | Rice | 405/286 |
| 936,843 | * | 10/1909 | Wood | 405/286 |
| 1,349,166 | * | 8/1920 | Paff | 405/286 |
| 2,129,369 | * | 9/1938 | Faber | 52/609 |
| 3,269,125 | * | 8/1966 | Moore | 405/286 |
| 4,379,659 | * | 4/1983 | Steiner | 405/284 |
| 4,433,944 | * | 2/1984 | Plica et al. | 405/284 |
| 4,521,138 | * | 6/1985 | Steiner | 405/284 |
| 4,923,339 | * | 5/1990 | Smith | 405/284 |
| 5,004,376 | * | 4/1991 | Vidal et al. | 405/284 |
| 5,066,169 | * | 11/1991 | Gavin et al. | 405/284 |
| 5,131,791 | * | 7/1992 | Kitziller | 405/286 |
| 5,350,256 | * | 9/1994 | Hammer | 405/286 |
| 5,403,127 | * | 4/1995 | Knudsen | 405/286 |
| 5,499,891 | * | 3/1996 | Klenert | 405/284 |
| 5,678,958 | * | 10/1997 | Rossi | 405/286 |
| 5,688,078 | * | 11/1997 | Hammer | 405/286 |
| 5,855,102 | * | 1/1999 | Chang | 52/604 |
| 6,010,279 | * | 1/2000 | Taylor-Smith | 405/286 |
| 6,089,792 | * | 7/2000 | Khamis | 405/262 |
| 6,122,881 | * | 9/2000 | Aubertot | 52/604 |

* cited by examiner

*Primary Examiner*—Thomas B. Will
*Assistant Examiner*—Alexandra K. Pechhold
(74) *Attorney, Agent, or Firm*—Hall, Priddy, Myers & Vande Sande

(57) ABSTRACT

A construction unit adapted for constructing a retaining wall to keep a bank of earth from sliding or water from flooding, includes a plurality of U-shaped concrete panels having at least one drain, at least two I-shaped concrete panels each of which is connected to the rear end of one of the U-shaped panels, and at least one concrete shelf plate both ends of which are received by shelf receiving recesses formed in the inner surfaces of the U-shaped panels and the I-shaped panels. The U-shaped panels are vertically piled and further include a vertical engagement means to engage with the plurality of said vertically piled U-shaped panels, and connection members to connect to the I-shaped panels. This vertical engagement means includes an upper hole formed in the top surface of a lower panel of the vertically piled U-shaped panels and a lower hole formed in the bottom surface of an upper panel of the vertically piled U-shaped panels, and a steel bar installed in the upper and lower holes. Concrete is filled into each of the cavity defined between the horizontally adjacent panels, and crushed stones are packed into the inner space defined by said U-shaped panels and two I-shape panels.

12 Claims, 4 Drawing Sheets

CONSTRUCTION UNIT FOR A RETAINING WALL AND A METHOD FOR CONSTRUCTING THE RETAINING WALL

BACKGROUND OF THE INVENTION

1. Field of the Invention

The present invention relates to a construction member adapted for constructing a retaining wall to keep a bank of earth from sliding or water from flooding. More particularly, the present invention relates to an assembly type construction member as a construction unit composed of a U-shape concrete panel and a concrete shelf plate installed in the rear side of the U-shape panel. Further, the present invention relates to a method for constructing a retaining wall by making use of a plurality of the construction unit.

2. Prior Art

Conventionally, concrete blocks have been commonly used in the construction of low height or small scale retaining wall, but in the case of great scale retaining wall construction, reinforced concrete wall have been built up by pouring concrete into wall-form at its own construction site.

However, such conventional reinforced concrete wall construction require a relatively wide bottom space for its foundation, thereby resulting in disadvantages such as long construction period, higher cost, and inefficient work. In addition to these disadvantages, since conventional reinforced concrete wall is rigid, this wall can not absorb or disperse the vibration energy and impact force caused by earth quake.

SUMMARY OF THE INVENTION

It is therefore a primary object of the present invention to overcome the above described disadvantages, that is, to provide an improved construction unit to construct a retaining wall which is improved in a bottom space, a construction period, and a construction cost.

Another object of the present invention is to provide an improved construction unit to construct a retaining wall which can withstand earth quake.

Further object of the present invention is to provide an improved construction unit to construct a retaining wall with a drainage structure.

Still further object of the present invention is to provide a method for constructing the above described retaining wall by making use of the improved construction unit.

In order to accomplish the above objects, the present invention provides a construction unit which can be vertically piled and horizontally arranged one by one to construct a retaining wall on a foundation. The construction unit is composed of a U-shape concrete panel having at least one drain, at least two I-shape concrete panels each of which is connected to the rear end of the U-shape panel, and at least one concrete shelf plate both ends of which are received by shelf receiving recesses formed in the inner surfaces of the U-shape panel and the I-shape panels.

The U-shape panel further includes a vertical engagement means to engage with the vertically piled U-shape panels, and connection members to connect to the I-shape panels. This vertical engagement means includes an upper hole formed in the top surface of the lower piled U-shape panel and a lower hole formed in the bottom surface of the upper piled U-shape panel, and a steel bar installed in the upper and lower holes.

The shelf plate is inclined downward at about 20° with respect to the horizontal plane.

The connection members are made of steel belt integrally formed in the rear ends of the U-shape panel and the front and rear ends of the I-shape panel, and are mechanically engaged through commonly used bolt and nut.

The drain is formed in a slit shape along the lower edge of the U-shape panel.

The U-shape panels and the I-shape panels are assembled to build up a retaining wall inclined rearward at about 10° with respect to the vertical plane.

According to another aspect of the present invention, a method for constructing a retaining wall by making use of the above described construction unit comprises following working steps for;

(1) forming a reinforced concrete foundation;

(2) placing a predetermined number of U-shape panels side by side on the foundation to make the first step face, which U-shape panel has at least one drain;

(3) placing two I-shape panels at the rear end of each the U-shape panel;

(4) mechanically connecting the rear end of the U-shape panel to the front end of the I-shape panel through a connection member;

(5) installing a shelf plate within shelf receiving recesses formed in the inside surfaces of the U-shape panel and I-shape panel so that the shelf plate is inclined downward at about 20° with respect to the horizontal face;

(6) arranging vertical reinforcing rods and horizontal reinforcing rods in the cavity like space defined between two construction units composed of the U-shape panel and I-shape panels;

(7) inserting a steel bar into the upper hole formed in the top surface of the first step U-shape panel;

(8) piling a second step U-shape panel on the first step panel with inserting the steel bar into the lower hole formed in the bottom surface of the second step panel;

(9) repeating the former working steps (2) to (8) up to the top step; and

(10) filling concrete into each of the cavity defined between the horizontally adjacent panels, and packing crushed stones into the inner space defined by the U-shape panel and two I-shape panels.

Thus constructed retaining wall is preferably inclined rearward at 10° with respect to the vertical plane. Since the construction unit according to the present invention is a self-standing structure, the retaining wall can be constructed upright in response to construction situation.

These and other objects and many of the attendant advantages of the present invention will be readily appreciated as the same becomes better understood by reference to the following detailed description when considered in connection with the accompanying drawings.

DETAILED DESCRIPTION OF THE PREFERRED EMBODIMENT

One preferred embodiment of the construction unit according to the present invention and a typical example of the retaining wall constructed by making use of a plurality of the construction unit and one preferred embodiment of method of the present invention will be explained in detail with referring to the accompanying drawings FIG. 1 to FIG. 5.

Figure 1:
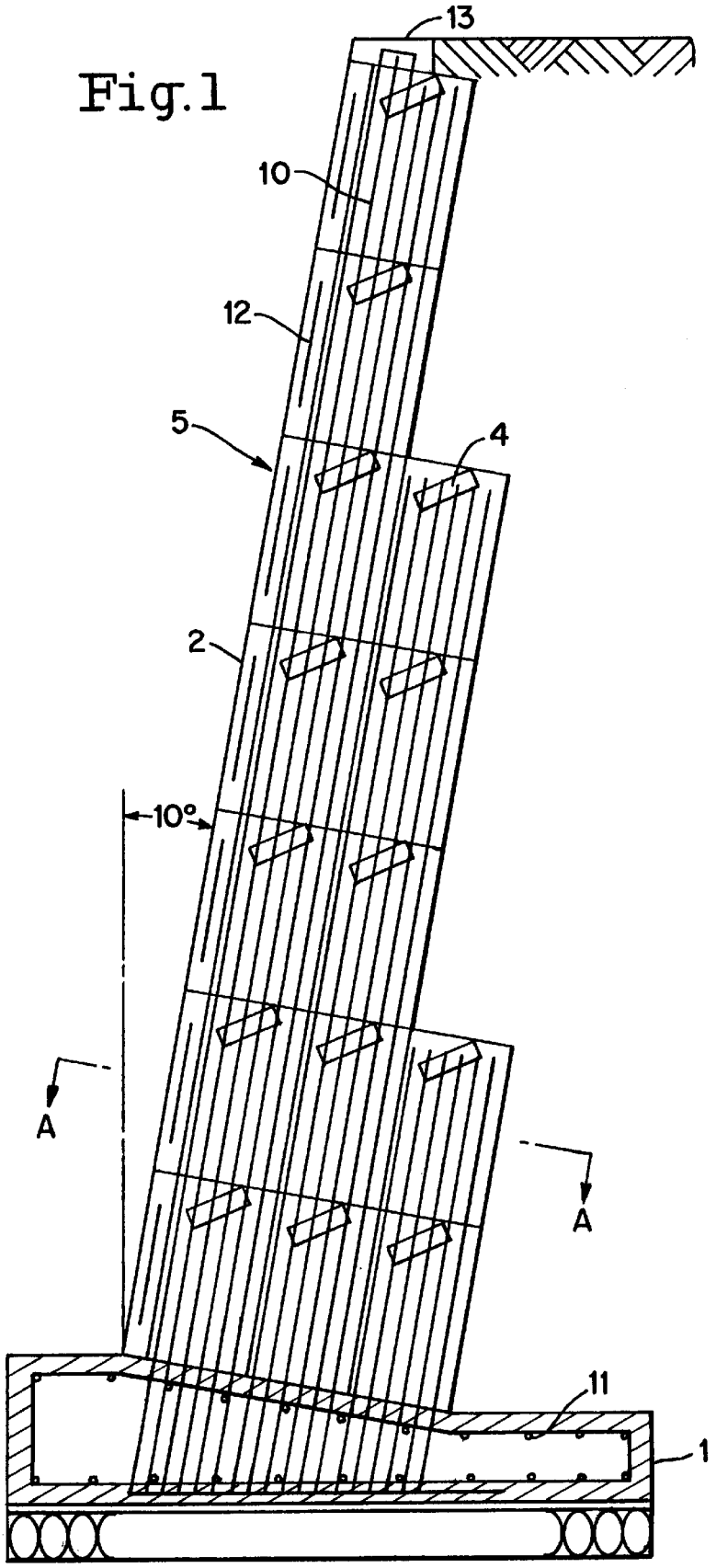
FIG. 1 is a vertically sectional view showing a retaining wall constructed by making use of a plurality of the construction unit according to the present invention.

First, FIG. 1 is a vertical section showing an overall of the retaining wall which is substantially composed of a foundation 1 containing reinforcing rods 11, and a plurality of concrete construction unit 5 vertically piled on the foundation 1.

Figure 2:
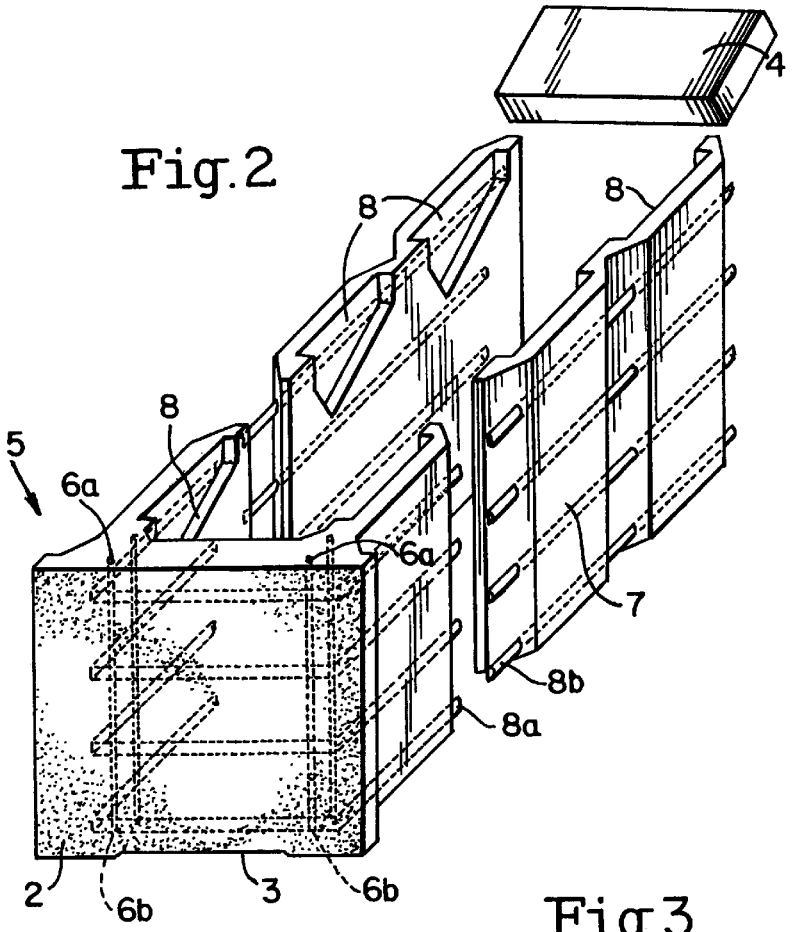
FIG. 2 is an enlarged exploded perspective view showing one typical preferred embodiment of the construction unit according to the present invention.

One preferred embodiment of the construction unit 5 is shown in detail in FIG. 2. The construction unit 5 is composed of a U-shape concrete panel 2 having a drain 3, at least two I-shape concrete panels 7 each of which is connected to the rear end of the U-shape panel 2, and at least one concrete shelf plate 4 both ends of which are received by shelf receiving recesses 8 formed in the inner surfaces of the U-shape panel 2 and the I-shape panel 7.

The U-shape panel 2 further includes a vertical engagement means to engage with the vertically piled U-shape panels 2, and connection members to connect to the I-shape panels 7. The vertical engagement means contains upper and lower holes 6*a* and 6*b* to receive a steel bar installed between these holes. This upper and lower holes 6*a* and 6*b* may be formed in a through hole. The U-shape panel 2 includes at least two vertical engagement means at both ends, preferably four.

From each rear end of the U-shape panel 2, the connection member 8*a* is protruded rearward to connect to corresponding connection member 8*b* protruded forward from the front end of the I-shape panel 7. In this preferred embodiment, these connection members 8*a* and 8*b* are made of steel belt integrally formed in the U-shape panel 2 and the I-shape panel 7, and are mechanically engaged through commonly used bolt and nut, not shown in the drawings. The rear end of the I-shape panel 7 is also provided with such connection members to connect further I-shape panels as required. Although FIG. 2 shows that each end of the U-shape panel 2 is provided with four connection members 8*a*, it is possible to increase or decrease in accordance with construction conditions.

The present invention further provides a preferred embodiment of method for constructing a retaining wall by making use of the above described construction unit. As shown in FIG. 1, seven U-shape panels 2 are piled up to form the retaining wall having a height about 3 m. The piled U-shape panels 2 are inclined rearward at 10° with respect to the vertical plane. The shelf plate 4 is inclined downward at 20° with respect to the horizontal plane. Accordingly, the shelf receiving recess 8 is so designed to make the front end of the shelf plate 4 to be inclined downward at 30° as shown in FIG. 2.

First, the predetermined number of the U-shape panels 2 are placed side by side on the foundation 1 to make the first step face. Two I-shape panels 7 are placed at the rear end of each the U-shape panel 2, and mechanically connected with each other through the connection members 8*a* and 8*b*. One or more I-shape panels 7 may be further connected to the first connected I-shape panel 7 as required. The shelf plate 4 is received by a facing pair of the shelf receiving recesses 8.

Figure 3:
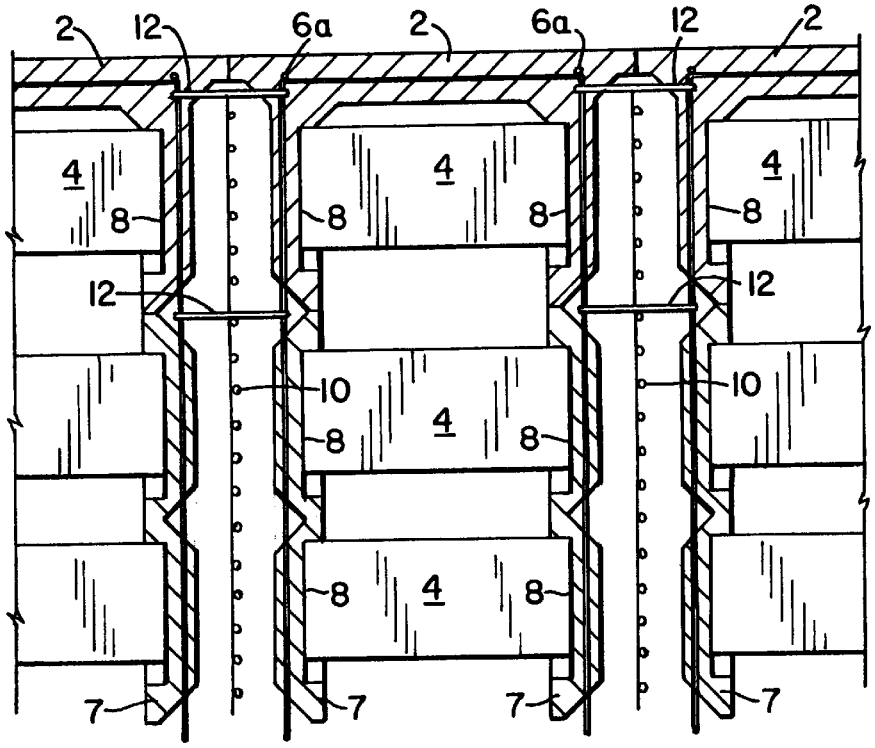
FIG. 3 is a cross sectional view taken along the line A—A in FIG. 1.

FIG. 3 is the cross-sectional view taken along the line A—A in FIG. 1, to show the plan view of the construction unit composed of the U-shape panel 2, the I-shape panels 7, and the shelf plates 4. In the cavity defined between two construction units 5, vertical reinforcing rods 10 and horizontal reinforcing rods 12 are arranged.

In order to build the second step, a steel bar is inserted into the upper hole 6*a* and an additional U-shape panel 7 is piled on the first step panel 7 with inserting the steel bar into the lower hole 6*b* of the second step panel 7.

The above described process is repeated up to the top step. At each step, the horizontal and vertical reinforcing rods 12 and 10 are mechanically connected in conventional manner. The top end of the vertical reinforcing rod 10 is bent to reinforce the berm 13 of top surface.

Figure 4:
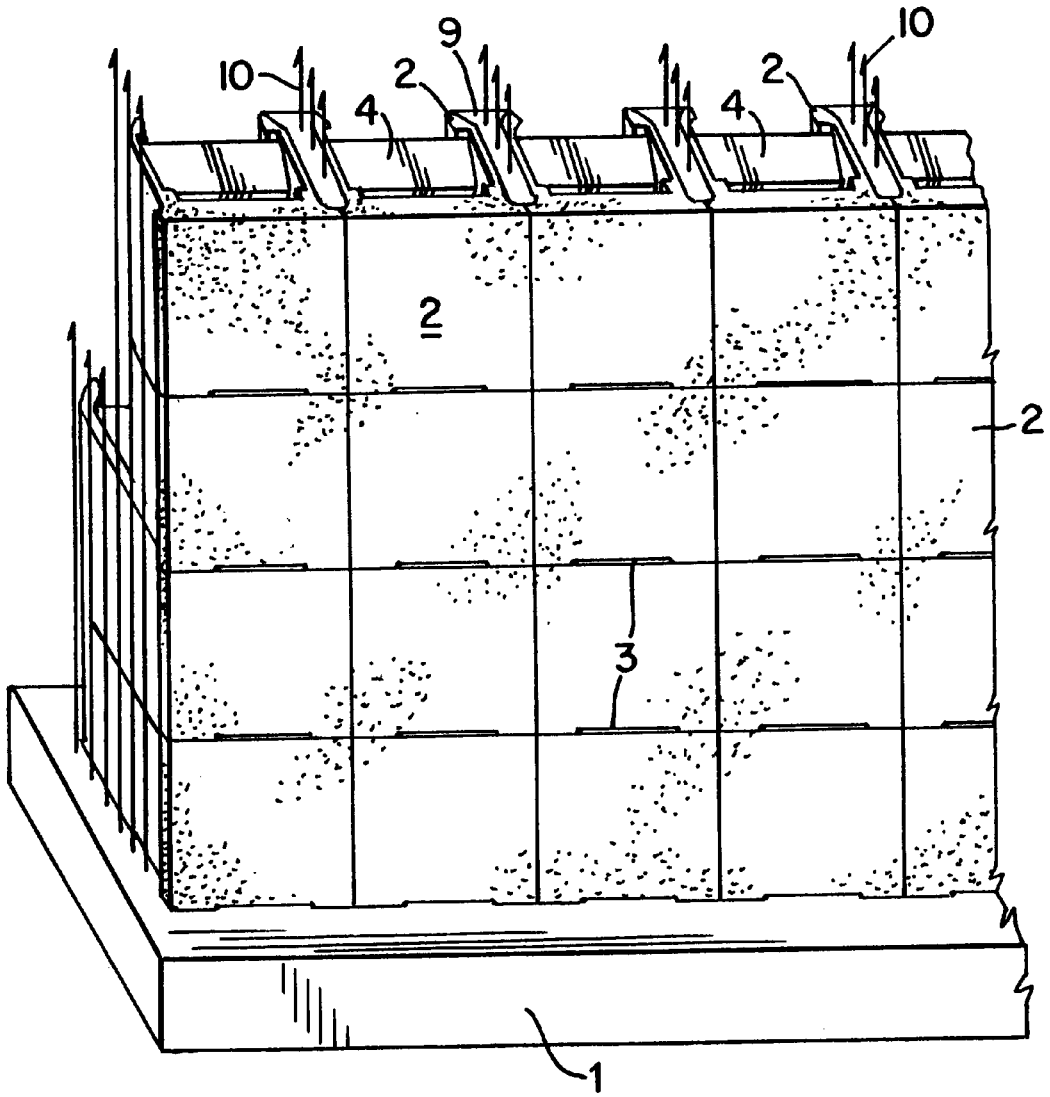
FIG. 4 is a perspective view showing a front face of the retaining wall constructed according to the present invention.
Figure 5:
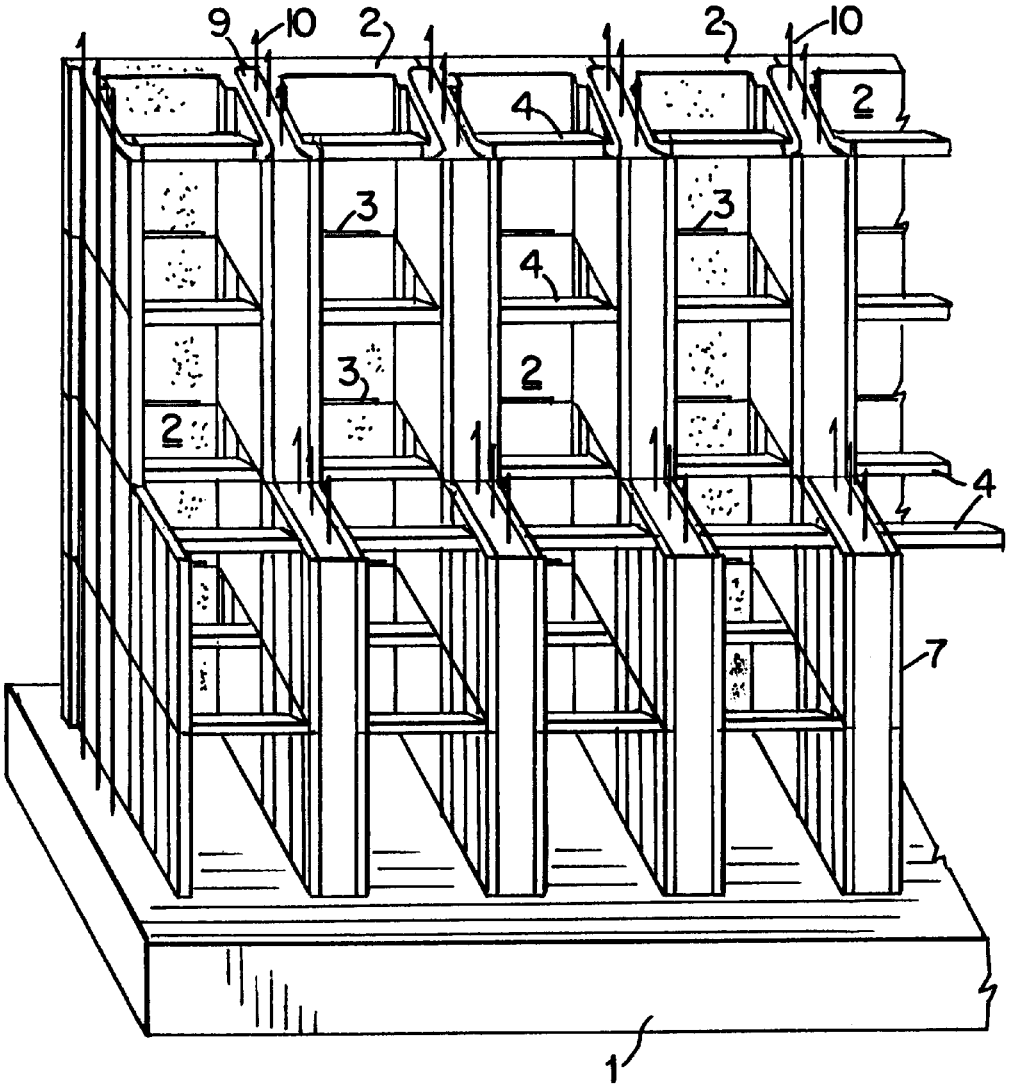
FIG. 5 is a perspective view showing a rear side structure of the retaining wall constructed according to the present invention.

After assembling the U-shape panels and the I-shape panels, and incorporating the reinforcing rods between these panels as shown in FIG. 4 and FIG. 5, the cavity 9 defined between the horizontally adjacent panels are filled with concrete, and then the inner space defined by the U-shape panel 2 and two I-shape panels is stuffed with crushed stone.

It is desirable to arrange the drain 3 on a level of the front end of the shelf plate 4 to increase draining efficiency.

As given explanation above, since the retaining wall constructed by making use of the construction unit according to the present invention is inclined rearward 10° with respect to the vertical plane, the bottom width required to make the foundation can be decreased rather than conventional construction methods. When the foundation is formed by full scale ground work, required ground durability can be decreased. When the foundation is formed by piles, the required number of piles can be reduced. This results in economical merits.

Since the retaining wall is constructed by connecting the construction units at substantially 1 m pitch, thus constructed retaining wall has a tenacious structure capable of absorbing vibration energy caused by earth quake and this retaining wall can be free from expansion joints conventionally used to improve vibration absorbing ability. In addition to this structure, this retaining wall includes a lot of the shelf plates inclined at 20° with respect to the horizontal face, which will act as reinforcing members to withstand the impact caused by earth quake.

Since the retaining wall according to the present invention has a lot of drains and the inner spaces of the wall are stuffed with crushed stones, rain water can be smoothly drained from the rear side of the retaining wall. This effect ensures that the retaining wall can keep a bank of earth from sliding by rain water.

The U-shape panel is provided with the connection holes to engage the upper or lower U-shape panel in combination with the steel bar, so that the stability and assemble work of the retaining wall can be improved.

The construction unit according to the present invention can be assembled in a self-standing manner which does not require an inclined wall construction.

As many apparently widely different embodiments of this invention may be made without departing from the spirit and scope, it is to be understood that the invention is not limited to the specific embodiments thereof except as defined in the appended claims.

What is claimed is:

1. A construction unit which is vertically piled and horizontally arranged one by one to construct a retaining wall to keep a bank of earth from sliding or water from flooding, comprising;

a plurality of U-shaped concrete panels having at least one drain;

at least two I-shaped concrete panels each of which is connected to the rear end of one of said U-shaped panels; and at least one concrete shelf plate, both ends of which are received by shelf receiving recesses formed in the inner surfaces of said U-shaped panels and said I-shaped panels.

2. The construction unit as set forth in claim 1, wherein said U-shaped panels are vertically piled and further include a vertical engagement means to engage with said plurality of said vertically piled U-shaped panels, and connection members to connect to said I-shaped panels.

3. The construction unit as set forth in claim 2, wherein said vertical engagement means includes an upper hole formed in the top surface of a lower panel of said vertically piled U-shaped panels and a lower hole formed in the bottom surface of an upper panel of said vertically piled U-shaped panels, and a steel bar installed in the upper and lower holes.

4. The construction unit as set forth in claim 2, wherein said connection members are made of steel belt integrally formed in the rear ends of said U-shaped panels and the front and rear ends of said I-shaped panels, and are mechanically engaged through commonly used bolt and nut.

5. The construction unit as set forth in claim 1, wherein said shelf plate is inclined downward at about 20° with respect to the horizontal plane.

6. The construction unit as set forth in claim 1, wherein said drain is formed in a slit shape along the lower edge of said U-shaped panels.

7. The construction unit as set forth in claim 1, wherein said U-shaped panels and the I-shaped panels are assembled to build up a retaining wall inclined rearward at about 10° with respect to the vertical plane.

8. The construction unit as set forth in claim 1, wherein said U-shaped panels and the I-shaped panels are assembled to build up a retaining wall at about 90° with respect to the horizontal plane.

9. A method for constructing a retaining wall by making use of the construction unit as set forth in claim 1 comprising following working steps for;

(1) forming a foundation;

(2) placing a predetermined number of said U-shaped panels side by side on said foundation to make a first step panel, said U-shaped panels having at least one drain;

(3) placing two of said at least two I-shaped panels at the rear end of each said U-shaped panel;

(4) mechanically connecting the rear end of each said U-shaped panel to the front end of each said I-shaped panel through a connection member;

(5) installing said at least one concrete shelf plate within said shelf receiving recesses formed in the inside surfaces of each said U-shaped panel and I-shaped panel so that said shelf plate is inclined downward at about 20° with respect to the horizontal plane;

(6) arranging vertical reinforcing rods and horizontal reinforcing rods in a cavity defined between adjacent construction units comprised of said U-shaped and I-shaped panels;

(7) inserting a steel bar into an upper hole formed in the top surface of the first step U-shaped panel;

(8) constructing a second step U-shaped panel on top of said first step panel which includes inserting a steel bar into a lower hole formed in the bottom surface of the second step panel;

(9) repeating steps (2) to (8); and

(10) filling concrete into any said cavity defined between horizontally adjacent panels, and packing crushed stones into an inner space defined by said U-shaped panels and two I-shaped panels.

10. The method as set forth in claim 9, wherein said retaining wall is inclined rearward at 10° with respect to the vertical plane.

11. The method as set forth in claim 9, wherein said retaining wall is built up at 90° with respect to the horizontal plane.

12. The method as set forth in claim 9, wherein said at least one drain is formed in a slit formed to extend along the lower edge of said U-shaped panels and said drain slit is arranged so as to be located on a level with the front end of said shelf plate thereby to increase draining efficiency.

* * * * *